United States Patent [19]

Duhart

[11] Patent Number: 4,982,641

[45] Date of Patent: Jan. 8, 1991

[54] GUITAR PICK HOLDER

[76] Inventor: Dean K. Duhart, P.O. Box 298, St. Ann, Mo. 63074

[21] Appl. No.: 462,062

[22] Filed: Jan. 8, 1990

[51] Int. Cl.[5] ..... G10D 3/16

[52] U.S. Cl. ..... 84/329; 84/322; 84/453; 224/267

[58] Field of Search ..... 84/322, 327, 329, 453; 224/219-221, 267, 910

[56] References Cited

U.S. PATENT DOCUMENTS

| | | | |
|---|---|---|---|
| 2,459,274 | 1/1949 | Galetzky | 84/322 |
| 3,124,286 | 3/1964 | Dompier | 224/220 |
| 4,067,255 | 1/1978 | Camaioni | 84/329 |
| 4,137,814 | 2/1979 | Rowley | 84/322 |
| 4,159,792 | 7/1979 | Siegal | 224/267 |
| 4,489,867 | 12/1984 | Schwemberger | 224/222 |
| 4,741,239 | 5/1988 | Crafton | 84/322 |
| 4,841,829 | 7/1989 | Lehmann | 84/385 A |

FOREIGN PATENT DOCUMENTS

| | | | |
|---|---|---|---|
| 999367 | 1/1952 | France | 224/267 |

*Primary Examiner*—Lawrence R. Franklin

*Attorney, Agent, or Firm*—Senniger, Powers, Leavitt & Roedel

[57] ABSTRACT

A guitar pick holder including a band removeably fitted around the arm of a guitar player generally at the wrist. A tether line having a first end and a second end opposite the first end is connected to the band at its first end and extends generally downwardly from the band. The length of the tether line extending down from the band substantially corresponds to the distance from the wrist to the fingertips of the guitar player. A guitar pick is connected to the second end of the tether line.

13 Claims, 1 Drawing Sheet

FIG. 2.
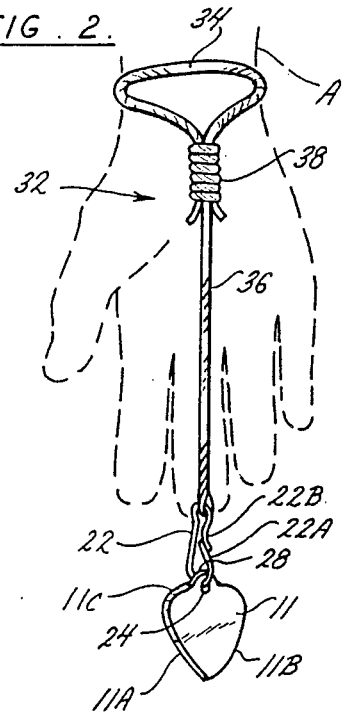
FIG. 1.
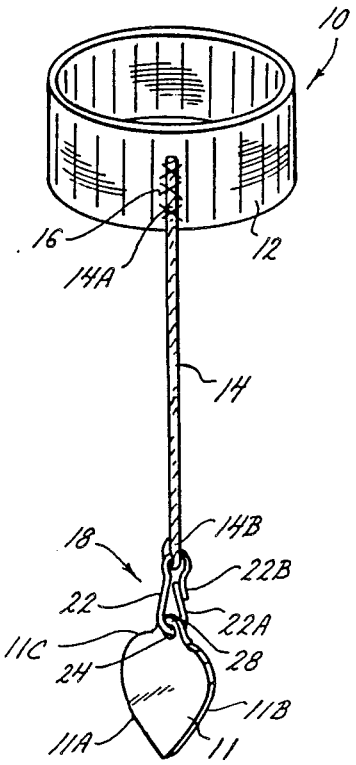
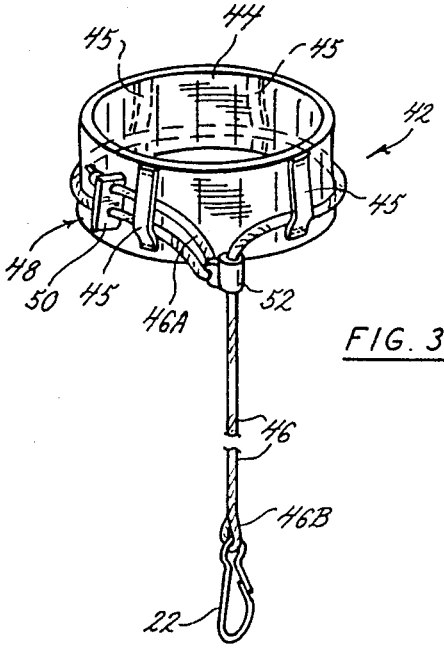
FIG. 3.

GUITAR PICK HOLDER

BACKGROUND OF THE INVENTION

This invention relates generally to picks for playing a musical instrument and more particularly to a guitar pick holder.

Picks of the type used for playing a guitar or similar stringed musical instruments are small in size and are easily dropped while playing the instrument. Because of the small size and often neutral colors of picks, they may become lost when dropped causing a considerable delay in playing while searching for the pick or securing a new pick. Such delays can be the source of considerable embarrassment and annoyance to the player when the pick is dropped while performing.

Attempts have been made to remedy the problem of dropping the pick while playing. Reference may be had to Camsioni, U.S. Pat. No. 4,067,255, which shows a retractable guitar pick attached to the guitar. However, with such a design, there is a considerable length of cable which could interfere with playing. Further, because of the length of the cable, the pick will, if dropped, fall a considerable distance away from the guitar player's hand requiring a stoppage of playing while the pick is retrieved.

Occasionally, the player may switch from playing the guitar with his fingers to playing with a pick. Presently, the player must reach some distance away from the guitar to retrieve the pick from, for instance, his pocket or from between his teeth. Again, the player must stop playing for a time while the pick is retrieved. The same delay occurs when the player switches back to playing the guitar with his fingers.

SUMMARY OF THE INVENTION

Among the several objects of the present invention is the provision of a holder for a guitar pick which tethers the guitar pick near the hand of the player; the provision of such a holder which holds one of any number of picks; the provision of such a holder which is adjustable; and the provision of such a pick holder which is economical to manufacture.

Generally, a guitar pick holder of the present invention includes a band removeably fitted around the arm of a guitar player generally at the wrist, and a tether line having a first end and a second end opposite the first end. The tether line is connected to the band at the first end thereof and extends generally downwardly from the band. Means at the second end of the tether line connects a guitar pick to the tether line. The length of the tether line extending generally downwardly from the band substantially corresponds to the distance from the wrist to the fingertips of the guitar player.

In another aspect of the present invention, a guitar pick holder as described above wherein the tether line and the band are made of a single length of material.

In still another aspect of the present invention, a holder as described, further including means for adjusting the length of the tether line extending from the band.

In yet another aspect of this invention, a guitar pick holder as described above in combination with a guitar pick.

BRIEF DESCRIPTION OF THE DRAWINGS

FIG. 1 is a perspective of a guitar pick holder of a first embodiment;

FIG. 2 is a perspective of a guitar pick holder of a second embodiment attached to the arm of a guitar player; and FIG. 3 is a perspective of a guitar pick holder of a third embodiment.

Corresponding reference characters indicate corresponding parts throughout the several view of the drawings.

DETAILED DESCRIPTION OF THE PREFERRED EMBODIMENTS

Referring now to the drawings and more particularly to FIG. 1, a guitar pick holder, generally indicated at 10, for tethering a guitar pick 11 to the arm of a guitar player is shown to comprise a band 12 and a tether line 14 extending from the band. It is to be understood that although the preferred embodiment relates to a pick holder for a guitar pick, the invention may also be used to hold picks for playing other instruments similar to guitars. The band 12 is fitted around the arm A of the Player generally at the wrist and comprises a closed loop of elastic material. The elastic material expands for slipping the band on and off of the wrist, and will securely fit around wrists of different sizes. The band 12 may also incorporate terry cloth or a similar absorbent material so that the band will function as a sweatband. The reduction of perspiration on the hands and fingers makes it easier to maintain a grip on the guitar pick 11. Although the band 12 is shown as incorporating elastic material, it may also be made of a strip of nonelastic material such as leather. In that event, a suitable adjustable fastener (not shown), such as a strap and a belt buckle or the like, is provided to connect the ends of the strip so that the band 12 may be securely fitted around wrists of different sizes.

The tether line 14 has a first end 14A and a second end 14B. The tether line 14 is attached at its first end 14A to the band 12 by stitching 16 and extends generally downwardly from the band. The length of the tether line 14 extending generally downwardly from the band 12 substantially corresponds to the distance between the wrist of the guitar player and his fingertips. Means, generally indicated at 18, at the second end 14B of the tether line connects the guitar pick to the tether line. As shown in FIG. 1, the attachment means 18 comprises a clasp 22 attached to the tether line 14 generally at its second end 18 may be provided for attaching the pick 11 to the tether line. The clasp 22 is generally hook-shaped and has an end portion 22A adapted to fit through an opening 24 in the guitar pick 11 for attaching the pick to the holder 10. The end portion 22A is adapted to move between an open position and a closed position (shown in FIG. 1). In its closed position, the end portion 22A engages a retainer portion 22B of the clasp to retain the pick 11 on the clasp. In its open position, the end portion 22A is deflected back from the retainer portion 22B and the pick 11 may be removed from the clasp. Therefore, a single guitar pick holder 10 may tether an indefinite number of picks such as may be required for playing different stringed instruments. The attachment means 18 may, as an alternative, comprise a knot tied in the second end 14A of the tether line after the tether line has been threaded through the opening 24 in the guitar pick so that it may not be pulled back through the opening (not shown).

As shown in FIG. 2, the length of the tether line 14 extending down from the band 12 substantially corresponds to the distance between the wrist and the fingertips of the guitar player, such that the pick 11, when attached to the second end of the tether line, is substantially adjacent the fingertips of the player. The relatively short length of the tether line 14 reduces the possibility of the tether line interfering with the playing of the guitar. Further, should the pick 11 be dropped while playing the guitar, it will not fall more than a few inches away from the player's hand. Therefore, a dropped pick 11 may be quickly retrieved requiring that playing of the guitar be stopped for only a few short moments. Similar advantages of substantially continuous playing are realized when switching from playing with the fingers to playing with a pick during a performance.

The guitar pick 11 of the present invention generally has the shape of an isosceles triangle, the three sides being indicated at 11A, 11B and 11C, respectively. The pick 11 has a boss 28 projecting outwardly from the side 11C of the pick corresponding to the base of the triangle. The opening 24 in the pick 11 is located in the boss 28, and thus the point of connection of the tether line 14 to the pick is set apart from the generally triangular surface area of the pick. Therefore, connection of the tether line 14 to the pick 11 does not reduce the gripping area normally available on the pick.

Referring now to FIG. 2 of the drawings a second embodiment of a guitar pick holder of the present invention, indicated generally at 32, is shown to comprises a band 34 and a tether line 36 constructed of a single piece of material. The piece of material is a strip of leather or like material configured in a slip knot or lanyard style arrangement. A knot 38 separates the looped portion of the piece of material, which defines the band 34, and the tether line 36. In this embodiment, the player expands the band 34 by pulling the tether line 36 back through the knot 38 so that the band may be slipped over the hand onto the wrist. The band 34 is then tightened around the wrist by pulling the tether line 36 out through the knot 38. The frictional engagement of the strip of material in the knot holds the tether line 14 in place with respect to the knot. It is to be understood that the tether line 14 could be secured in position relative to the knot 38 by other means.

A third embodiment of the present invention, shown in FIG. 3, is substantially similar to the FIG. 1 embodiment. In the third embodiment, a guitar pick holder, generally indicated at 42, includes a band 44 and a tether line 46. The third embodiment further includes means indicated generally at 48, for adjusting the length of the tether line 46 extending from the band 44. The tether line 46 is sufficiently long to be wrapped around the band 44, and is received through belt loops 45 attached to the band to hold the tether line on the band. A first end portion 46A of the tether line is slidably received through an openings in a slide fastener 50 and a sleeve 52. The end portion 46A then is doubled back on itself and secured to the slide fastener 50. A second end portion 46B is slidably received through the sleeve 52 and extends down to the guitar pick clasp 22. The length of the tether line 46 extending down from the sleeve 52 can be shortened by sliding the fastener 50 (to the left as viewed in FIG. 3) to increase the length of the end portion 46A which is doubled back upon itself. Conversely, the length of the tether line extending down from the sleeve may be increased by sliding the fastener 50 to decrease the length of the end portion 46A which is doubled back upon itself. Once the tether line 46 has been adjusted, the frictional engagement of the tether line in the slide fastener 50 holds the tether line in place. Thus, the guitar pick holder may be adjusted according to the particular size of the player's hand so that the pick is suspended generally adjacent the player's fingertips.

In view of the foregoing, it may be seen that the guitar pick holder of the present invention tethers the pick to the arm of the player generally adjacent the hand so that the pick remains close to the player's hand for a quick recovery when dropped. The pick 11 is also close to the hand for a quick change from playing the guitar with the fingers to playing with a pick with a minimal stoppage of play. The guitar pick holder has a clasp which releasably holds the pick 11 so that a single guitar pick holder may be used with an indefinite number of guitar picks. Further, the guitar pick holder may include means for adjusting the length of the tether line 14 extending from the band so that the pick may be located generally adjacent the fingertips of the player. Finally, the guitar pick holder of the present invention may be constructed from readily available, inexpensive materials with a minimum number of manufacturing steps so that it may be inexpensively provided as an accessory for guitars or the like.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A guitar pick holder comprising a band made of absorbent material such as terry cloth o r the like removeably fitted around the arm of a guitar player generally at the write, a tether line having a first end and a second end opposite said first end, the tether line being connected to the band at said first end thereof and extending generally downwardly from the band, the length of the tether line extending generally downwardly from the band substantially corresponding to the distance from the wrist to the fingertips of the guitar player, and means at the second end of the tether line for connecting a guitar pick to the tether line.

2. A guitar pick holder as set forth in claim 1 wherein the band is elastic.

3. A guitar pick holder as set forth in claim 1 wherein said attachment means comprises a clasp connected to the tether line generally at its second end.

4. A guitar pick holder as set forth in claim 1 further comprising means for adjusting the length of the tether line extending from the band.

5. A guitar pick holder as set forth in claim 4 wherein said length adjusting means comprises a slide fastener adapted to releasably hold the tether line at a length of adjustment.

6. A guitar pick holder in combination with a guitar pick comprising a band removeably fitted around the arm of a guitar player generally at the writs, a tether line having a first end and a second end opposite said first end, the tether line being connected to the band at said first end thereof and extending generally downwardly from the band, the length of the tether line extending generally downwardly from the band substantially corresponding to the distance from the wrist to the fingertips of the guitar player, the guitar pick including a generally triangular portion having a gripping surface on either face thereof and a boss projecting outwardly from the generally triangular portion, the boss having an opening therein for connection of the second end of the tether line to the pick whereby connection of the pick to the tether line does not reduce the available area on said gripping surfaces for gripping the pick.

7. A guitar pick holder in combination with the guitar pick as set forth in claim 6 wherein the band is made of elastic material.

8. A guitar pick holder in combination with a guitar pick as set forth in claim 6 wherein the band is made of absorbent material such as terry cloth or the like.

9. A guitar pick holder in combination with a guitar pick as set forth in claim 6 wherein the band and the tether line are formed from a single piece of material.

10. A guitar pick holder in combination with a guitar pick as set forth in claim 6 further comprising means at the second end of the tether line for connecting the guitar pick to the tether line, said connecting means comprising a clasp connected to the tether line generally at its second end.

11. A guitar pick holder in combination with a guitar pick as set forth in claim 10 wherein the guitar pick opening is to receive the clasp for attaching the guitar pick to the tether line.

12. A guitar pick holder in combination with the guitar pick as set forth in claim 6 further comprising means for adjusting the length of the tether line extending from the band.

13. A guitar pick holder in combination with the guitar pick as set forth in claim 12 wherein said length adjusting means comprises a slide fastener adapted to releasably hold the tether line at a length of adjustment.

* * * * *